US005127300A

United States Patent [19]

Silverman

[11] Patent Number: 5,127,300

[45] Date of Patent: Jul. 7, 1992

[54] PICK HOLDER FOR A STRINGED MUSICAL INSTRUMENT

[76] Inventor: Martin D. Silverman, 1091 Lynwood Blvd., Nashville, Tenn. 37215

[21] Appl. No.: 656,854

[22] Filed: Feb. 19, 1991

[51] Int. Cl.[5] ..... G10D 3/00

[52] U.S. Cl. ..... 84/329

[58] Field of Search ..... 84/322, 329, 453

[56] References Cited

U.S. PATENT DOCUMENTS

| | | | |
|---|---|---|---|
| 570,321 | 10/1896 | Mahler | 84/329 |
| 631,729 | 8/1899 | Smith | 84/329 |
| 3,181,410 | 5/1965 | Phillips | 84/329 |
| 4,505,177 | 3/1985 | Schaller | 84/329 |
| 4,790,232 | 12/1988 | Rosen | 84/329 |

FOREIGN PATENT DOCUMENTS

| | | | |
|---|---|---|---|
| 2208255 | 3/1989 | United Kingdom | 84/329 |

*Primary Examiner*—W. B. Perkey
*Assistant Examiner*—Cassandra C. Spyrou
*Attorney, Agent, or Firm*—Harrington A. Lackey

[57] ABSTRACT

A holder adapted to be detachably secured to a stringed musical instrument, such as a guitar, for holding a plurality of picks and an Allen wrench upon the body of a stringed musical instrument. The holder includes an elongated base and an elongated clip arm secured at one set of edges in spaced apart relationship by a connecting arm in such a manner that the clip arm is elastically biased toward the base in order to yieldably support a plurality of guitar picks between the base and the clip arm. The same holder includes in the top surface of the clip arm, an elongated recess uniquely shaped to receive an Allen wrench snugly received within the recess and which may be inserted and removed from the recess either longitudinally or transversely of the recess.

8 Claims, 1 Drawing Sheet

PICK HOLDER FOR A STRINGED MUSICAL INSTRUMENT

BACKGROUND OF THE INVENTION

This invention relates to a pick and tool holder for a stringed musical instrument, and more particularly to a detachably secured holder for the body of a stringed musical instrument adapted to hold guitar picks and an Allen wrench.

Pick holders of various types adapted to be attached to the body of a stringed musical instrument are well known in the art, as illustrated in the following U.S. Pat. Nos.:

| | | |
|---|---|---|
| 570,321 | Mahler | Oct. 27, 1896 |
| 631,729 | Smith | Aug. 22, 1899 |
| 749,616 | Knell | Jan. 12, 1904 |
| 1,570,905 | Martell | Jan. 26, 1926 |
| 1,645,918 | Miele | Oct. 18, 1927 |
| 3,181,410 | Phillips | May 4, 1965 |
| 3,595,118 | Paxton | July 27, 1971 |
| 3,752,019 | Watrous | Aug. 14, 1973 |
| 4,135,431 | Ferguson | Jan. 23, 1979 |
| 4,467,693 | Nasfell, Jr. | Aug. 28, 1984 |
| 4,785,708 | Vaughan | Nov. 22, 1988 |
| 4,790,232 | Rosen | Dec. 13, 1988 |

All of the above patents, except Nasfell, Jr., disclose pick holders mounted in convenient locations upon a stringed musical instrument. The Nasfell, Jr. patent discloses a spring-clip type pick holder adapted to be mounted upon a microphone stand.

The patents to Mahler, Knell, Martell, Watrous, Ferguson and Nasfell, Jr. disclose spring-type clip holders or holders having resilient retainer members.

Phillips, Watrous, Ferguson, Vaughan, and Rosen disclose pick holders mounted upon the body of the stringed musical instrument by adhesives.

The Nasfell, Jr. and Rosen patents disclose guitar pick holders which are also provided with means for holding other articles.

The Schaller U.S. Pat. No. 4,505,177, issued Mar. 19, 1985, discloses a stemmed tool holder detachably mounted upon the body of a stringed musical instrument for supporting a pair of Allen wrenches.

None of the above patents disclose a device attachable to the body of a stringed musical instrument, such as a guitar, adapted to hold both guitar picks and an Allen wrench, much less a device having the structure of this invention for supporting a plurality of guitar picks and an Allen wrench.

SUMMARY OF THE INVENTION

The tool holder for detachably mounting upon the body of a stringed musical instrument is particularly adapted for supporting a plurality of guitar picks and an Allen wrench.

The holder made in accordance with this invention is a unitary molded clip member made from an elastic plastic material having a pair of jaws or arms normally biased toward each other for gripping the picks and in which one of the plastic arms is provided with an elongated recess for snugly and detachably receiving at least the elongated shank of an Allen wrench. The clip member includes an elongated base having a widthwise dimension having its remote or closed end portion connected through a connecting arm to the closed end portion of an elongated clip arm upon which is formed a clip contact portion opposing and normally biased into engagement with the opposing surface of the base. Formed on the opposite side of the clip contact portion is the elongated recess having a minimum amount of angled walls corresponding to the angled walls of the hex-shaped shank of the Allen wrench for snug engagement thereof. The clip arm is also provided with an outwardly diverging cam surface projecting from the clip contact portion for engagement by a pick moving toward the cam surface in order to spread the contact portion away from the base in order to permit free entry of the pick between the clip arm and the base, in order to snugly hold the one or more picks between the base and the clip arm.

Not only is the tool made in accordance with this invention designed to detachably hold each of the picks, but also to detachably hold the Allen wrench upon the body of the stringed musical instrument. Furthermore, the entire tool holder is preferably secured by a detachable adhesive to the surface of the body of the stringed instrument, such as the head stock of a guitar. The location of the holder upon the body of the instrument is solely within the choice of the musical performer, and could be mounted upon the face of the body of the instrument, the side wall of the body, the back, or even possibly in some position upon the neck or the head of the instrument.

DESCRIPTION OF THE PREFERRED EMBODIMENT

Figure 1:
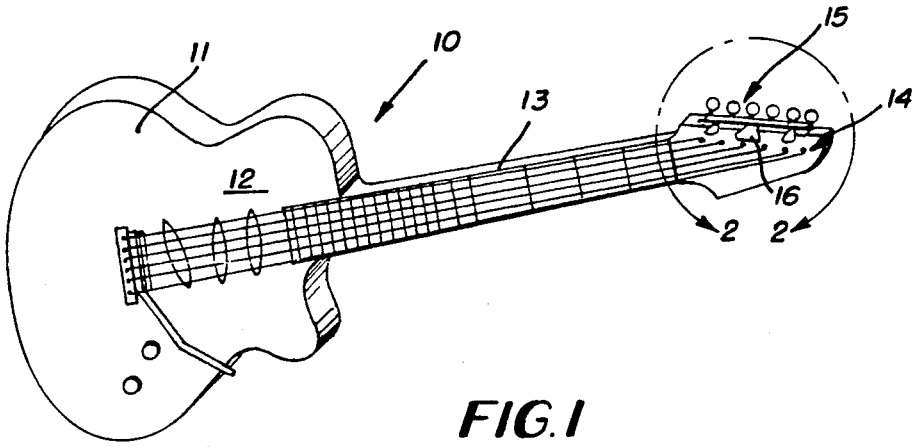
FIG. 1 is a top perspective view of a stringed musical instrument, specifically a guitar, upon the head stock of which is mounted the holder made in accordance with this invention.
Figure 2:
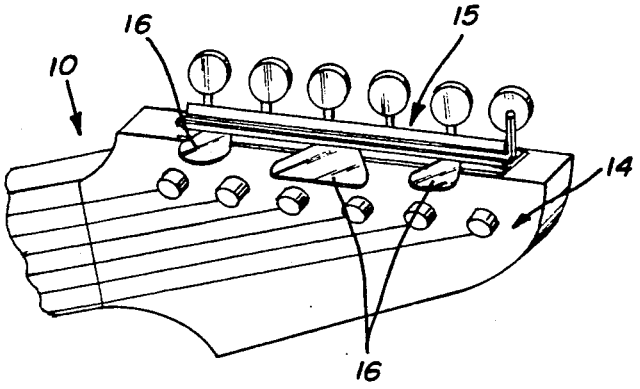
FIG. 2 is an enlarged, fragmentary view of the head stock supporting the holder.

Referring now to the drawings in more detail, FIG. 1 discloses a stringed musical instrument in the form of a guitar 10 having a body or sound box 11 including a front face 12 and a neck 13. Mounted on the head stock 15 adjacent its edge portion is a holder or tool holder 15 made in accordance with this invention.

Figure 3:
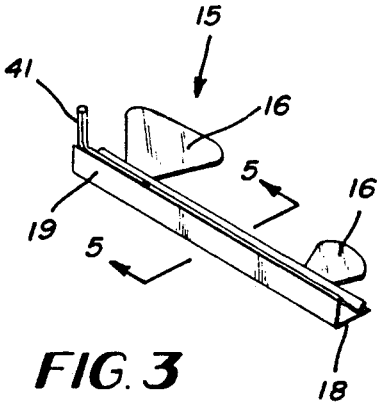
FIG. 3 is a top perspective view of the tool holder looking at the closed side of the holder, and on which two guitar picks and an Allen wrench are mounted.
Figure 4:
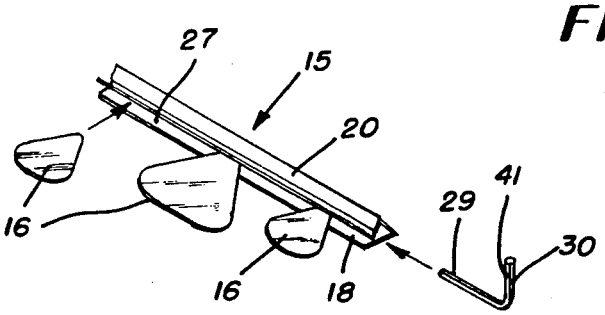
FIG. 4 is a top perspective view of the tool holder looking at the open-edged portion of the holder disclosed in FIG. 3, in which the Allen wrench and two of the guitar picks are held, and a third guitar pick is shown approaching entry into the holder.
Figure 5:
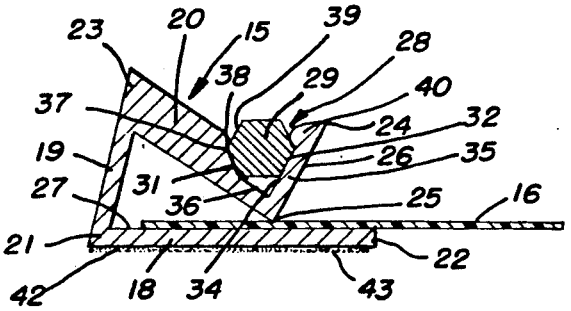
FIG. 5 is an enlarged section taken along the line 5—5 of FIG. 3.

The tool holder 15 per se is best disclosed in FIGS. 3, 4, and 5, and is shown as molded in a unitary or one-piece device 15 of an elastic plastic material, such as polypropylene.

The tool holder 15 is basically, or generally, a clip member having a pair of opposed arms or jaws which are biased together toward each other in order to retain the flat picks 16 therebetween. Specifically, the holder 15 includes an elongated base 18 connected at one edge portion by a connecting arm or arm member 19 to one edge portion of an angular jaw or clip arm or clip arm member 20. The base 18 is preferably flat and has a widthwise dimension terminating in a remote or closed edge portion 21 and a proximate or open-edge portion 22, as best disclosed in FIG. 5. The closed-edge portion 21 merges into the lower or bottom edge portion of the connecting arm 19. The upper edge portion of the connecting arm 19 is connected to or merges with the closed-edge portion 23 of the clip arm 20 in such a manner that the clip arm 20 converges back upon the base member of the base 18. The free-edge portion 24 of the clip arm 20 is bent back upon itself from the clip contact portion or edge 25 to form a cam surface 26 diverging away from the open-edge portion 21 of the base 18. Thus, as best disclosed in FIG. 4, it will be seen that a pick 16 moving in the direction of the arrow disclosed in FIG. 4, and along the top surface 27 of the base 18 in FIG. 5 will initially engage the cam surface 26 causing the clip contact edge 25 to rise over the leading edge of the pick 16 and move over the top of the pick 16 in order to hold the pick securely against the base 18, as shown in FIG. 5. Moreover, when it is desired to remove the pick 16, it is merely withdrawn to the right of FIG. 5 until the pick 16 is completely removed and the contact surface 25 is biased down against the top surface 27 of the base 18.

It will be noted, particularly in FIG. 5, that the thickness of the clip arm 20 is substantially greater than the thickness of the connecting arm 19 or the thickness of the base 18. The thicknesses of the connecting arm 19 and the base 18 are such as to give the particular material utilized in the formation of the tool holder 15 enough elasticity to cause the clip contact portion 25 to be biased into a tight gripping relationship with the pick 16, yet not so great as would damage the pick or prevent the pick from being readily removed by the guitar player. The clip arm 20 is made substantially thicker than the arm 19 and the base 18 to provide additional mass within which to form an elongated tool recess 28. The tool recess 28 is uniquely designed to receive the elongated shank 29 of the Allen wrench 30. The cross-sectional shape of the shank 29 is that of a regular hexagon, having surfaces or faces, such as 31 and 32.

The configuration of the tool recess 28 includes a right bottom wall 34 forming the inside surface of the portion of the clip arm wall 35 projecting upward from the clip contact portion. Thus, the inner recess surface 34 is substantially parallel to the cam surface 26. The inner right recess wall 34 intersects a bottom left recess surface 36 which projects upward toward the closed end of the clip wall 20 and then intersects a recess surface 37 which rests flush against and is coincident with the shank face 31, being of substantially the same width and length as the face 31. The upper edge of the recess face 37 terminates in a reverse arcuate retainer surface or protuberance 38 which extends slightly over the top face 39 of the Allen wrench shank 29. In like manner, the upper edge of the surface 32 terminates also in a reversely curved or arcuate retainer surface or protuberance 40 which extends slightly over the opening downward into the tool recess 28. These protuberances 38 and 40 are just slight enough to aid in holding the shank 29 within the recess against upward movement, yet permit the shank 29 to be laid on top of the recess 28 and then forced downward urging the protuberances 38 and 40 apart until the shank 29 has cleared the protuberances and is firmly seated against the hex surfaces 31 and 32.

The above-described recess surfaces also permit free longitudinal insertion or removal of the shank 22 from the end of the tool recess 28, if desired.

As best disclosed in FIGS. 3 and 4, the length of the tool holder 15 is preferably longer than the shank 29 of the Allen wrench 30 so that the entire shank 29 may be received snugly within the tool recess 28. The handle 41 of the Allen wrench 30 may be used in manipulating the Allen wrench 30 to push and pull the Allen wrench into and out of the open end of the tool recess 28, if desired.

Secured to the bottom surface 42 of the base 18 is an adhesive layer or coating 43. The bottom surface 42 of the base 18 may then be secured to the guitar body 11, such as the head stock 14, by means of the adhesive layer 43, as illustrated in FIG. 1.

In order to use the tool holder 15, the tool holder 15 is secured as described above upon any desired portion of the body 11 of the guitar 10, which is convenient for the guitar player or the operator.

Also, because of the additional length of the tool holder 15, more than one guitar pick 16 may be held by the holder 15 upon the guitar body 11, as illustrated in FIGS. 3 and 4. Simultaneously, the Allen wrench 30 is held by the same holder 15, which holds the several guitar picks 16. Thus, not only is the guitar player secure or at least feels secure against the los or dropping of guitar picks while performing, by being able to retrieve any guitar pick 16 held by the holder 15, he is also assured of having immediately available the Allen wrench 30, a tool which is frequently needed by a guitar player while he is performing, in order to string or tune the guitar at a moment's notice.

Moreover, when the tool holder 15 is empty, the tool recess 28 may be easily reloaded by obtaining and inserting another Allen wrench 30 into either open end of the recess 28 and having the wrench 30 held in position by merely releasing the wrench while the shank 29 is held by the various faces or surfaces of the interior of the recess 28, as best illustrated in FIG. 5.

Moreover, guitar picks 16 may easily be loaded at any time when additional guitar picks are needed in the tool holder 15. Each pick 16 is merely laid upon the open top surface 27 of the base 22 and slipped in against the cam surface 26 to elevate the clip contact portion until the pick 16 has been inserted to its desired depth, such as those disclosed in FIGS. 3 and 4, and released. The picks 16 left in their inserted positions are automatically held by the biased engagement of the clip contact portion 25 against the top surface 27 of the base 18. Thus, the tool holder 15 is reloaded and available for supplying an Allen wrench 30 or a guitar pick 16, whenever it is needed, and particularly if needed during a performance.

What is claimed is:

1. A holder for a stringed musical instrument pick and an Allen wrench, comprising:

(a) an elongated base having a widthwise dimension and terminating in a closed edge portion and an open-edge portion, (b) an elongated clip arm member having a widthwise dimension, an enclosed edge, an opposed free edge, and a clip contact portion between said closed edge portion and said free edge, (c) a connecting arm member connecting said closed edge portions in spaced apart relationship normally to elastically bias said clip contact portion against said base, (d) said portion of said clip arm member between said clip contact portion and said free edge comprising a cam surface diverging away from said clip contact portion toward said free edge, (e) said clip contact portion yielding away from said base when said cam surface is engaged by a pick slidably moving on said base toward said closed end portion of said base, (f) an elongated recess formed in said elongated clip arm member adapted to receive an Allen wrench, and (g) means for detachably securing said base to the stringed musical instrument.

2. The holder according to claim 1 in which said clip arm member has a top surface and a bottom surface, said clip contact portion being formed on said bottom surface and said recess being formed in said top surface.

3. The holder according to claim 2 in which said clip arm member's thickness is substantially greater than said connecting arm member's thickness.

4. The holder according to claim 3 in which said elongated clip arm member's thickness is substantially greater than said base's thickness.

5. The holder according to claim 2 in which an Allen wrench to be received in said recess has a cross-section which is a regular hexagon and in which said recess comprises a pair of elongated walls adapted to snugly engage flush against a pair of downward converging faces of the Allen wrench received in said recess.

6. The holder according to claim 5 in which a portion of said recess is adapted to project inward and upward in order to engage a portion of the top face of the Allen wrench received in said recess whereby said Allen wrench is adapted to be received in said recess by longitudinal insertion of said Allen wrench longitudinally of said recess or which may be depressed downwardly into said recess by spreading said top portion for snap-fastening said wrench into said recess.

7. The holder according to claim 6 in which said recess further comprises opposed inward and upward converging protuberances capable of retaining the top surface of the Allen wrench received in said recess against normally upward movement without spreading said opposed protuberances.

8. The holder according to claim 1 in which said recess has a length at least long enough to wholly receive a shank portion of an Allen wrench and to receive a plurality of longitudinally spaced picks flat on said base between said base and said clip contact portion.

* * * * *